US005256081A

United States Patent [19]

Didier

[11] Patent Number: 5,256,081

[45] Date of Patent: Oct. 26, 1993

[54] ATTACHABLE AIRCRAFT GROUND POWER CONNECTOR

[75] Inventor: Robert G. Didier, Santa Rosa, Calif.

[73] Assignee: BIW Connector Systems, Inc., Norwood, Mass.

[21] Appl. No.: 994,675

[22] Filed: Dec. 22, 1992

[51] Int. Cl.[5] ..... H01R 13/00

[52] U.S. Cl. ..... 439/464; 439/274

[58] Field of Search ..... 439/271-282, 439/449, 460, 462, 464

[56] References Cited

U.S. PATENT DOCUMENTS

| | | | |
|---|---|---|---|
| 3,794,960 | 2/1974 | Sugar | 439/464 |
| 3,823,254 | 7/1974 | Smith | 439/464 |
| 3,913,956 | 10/1975 | Eidelberg et al. | 439/464 |
| 4,758,175 | 7/1988 | Didier et al. | 439/281 |
| 4,797,117 | 1/1989 | Ayers | 439/464 |

*Primary Examiner*—Joseph H. McGlynn

*Attorney, Agent, or Firm*—Kenway & Crowley

[57] ABSTRACT

An attachable aircraft ground connector which includes a connector body insertable in the input power socket of a parked aircraft, the connector body having a replaceable nose and contacts at one end and a grommet mounted at the other end, the grommet being detachably retained in place by removable screws and the body and grommet having complementary resilient elements so disposed and cooperating as to maintain a sealing relationship between the two under the urging of said removable screws. Within the grommet, a peripheral clamp is provided to hold in place an input power line.

5 Claims, 4 Drawing Sheets

ATTACHABLE AIRCRAFT GROUND POWER CONNECTOR

This invention relates in general to systems for providing electrical power to aircraft when they are on the ground with engines shut down. In particular, the invention concerns replaceable connector elements for cables used in such power systems.

In the earlier U.S. Pat. No. 4,758,175, issued Jul. 19, 1988, for Aircraft Ground Power Cable and assigned to the same assignee as the present invention, there is disclosed a connector element integrally molded to a ground power cable and having at its terminal end a replaceable nose section and contacts serving electrically for power transfer and mechanically as retainers.

As explained in the previous patent, it is frequently necessary to provide power to an aircraft parked at a terminal or in a hangar when operation of the engines to provide power is undesirable. Generally, the aircraft is equipped with a suitable power input socket to which there is extended a cable from a power source with an end plug to be inserted in that socket. In the patent, the disclosure of which is hereby incorporated by reference, some of the problems are outlined that arise in using such power sources for aircraft on the ground. Chief among the problems is the damage which frequently occurs when a cable is pulled from the socket and allowed to drop to the concrete or asphalt surface below. Further damage frequently ensues if the cable is reeled in and the connector plug is dragged along the ground. During the process, the connector plug becomes abraded or even broken by harsh contact with the ground surface. Moreover, the cable connector is often exposed to extreme weather conditions and also to immersion in water or contamination from petroleum products being delivered to the plane. For those reasons, it was thought necessary that the connector be integrally molded to the power cable, and that has been common practice.

Although field replacement of the nose portion and terminals as taught in the earlier patent has been found to be a very useful practice, there are times when it would be desirable to have the entire connector, including the replaceable nose and contacts, attachable to the cable in the field.

The design of such a connector is a daunting challenge because it would inevitably include several loose components which must be easily assembled by personnel who would not normally be skilled or trained in such assembly work. Moreover, they would not usually have any but simple tools available, and the final assembly must be environmentally sealed for outdoor high-voltage, high-current use. It is therefore the primary object of the present invention to provide an attachable connector for a power cable which is capable of easy attachment by relatively unskilled personnel.

Another object is the provision of a sealed connector-cable assembly which is of rugged construction and highly resistant to effects of severe weather and environmental conditions.

A further object is a reliable and long-lasting attachable connector for a power cable for aircraft.

SUMMARY OF THE INVENTION

The foregoing and other objects, features and advantages are achieved by the present invention by utilizing a sub-assembly of a connector body and a grommet which are closely related in concept to the connector of my above-cited patent which, as noted, includes a connector body and a replaceable nose. Where a jacketed cable is used, the grommet has an exterior shell which has a lip or extension which receives a complementary extension from the connector body in sealing relationship. It also includes an adjustable clamp for holding the cable in alignment with the connector body. Sealing of the jacket of the round cable to the grommet is effected by a cylindrical rubber lip formed within the grommet.

In the case of banded individual single conductors, raised rubber cones are formed on the body about each socket contact. The cones are received in complementary tapered openings formed in the grommet to effect sealing. Also, the body and grommet have overlapping extensions on their exterior shells.

For a better understanding of the present invention, there follows a description of preferred embodiments which should be read with reference to the appended drawing in which.

DESCRIPTION OF PREFERRED EMBODIMENTS

Figure 1:
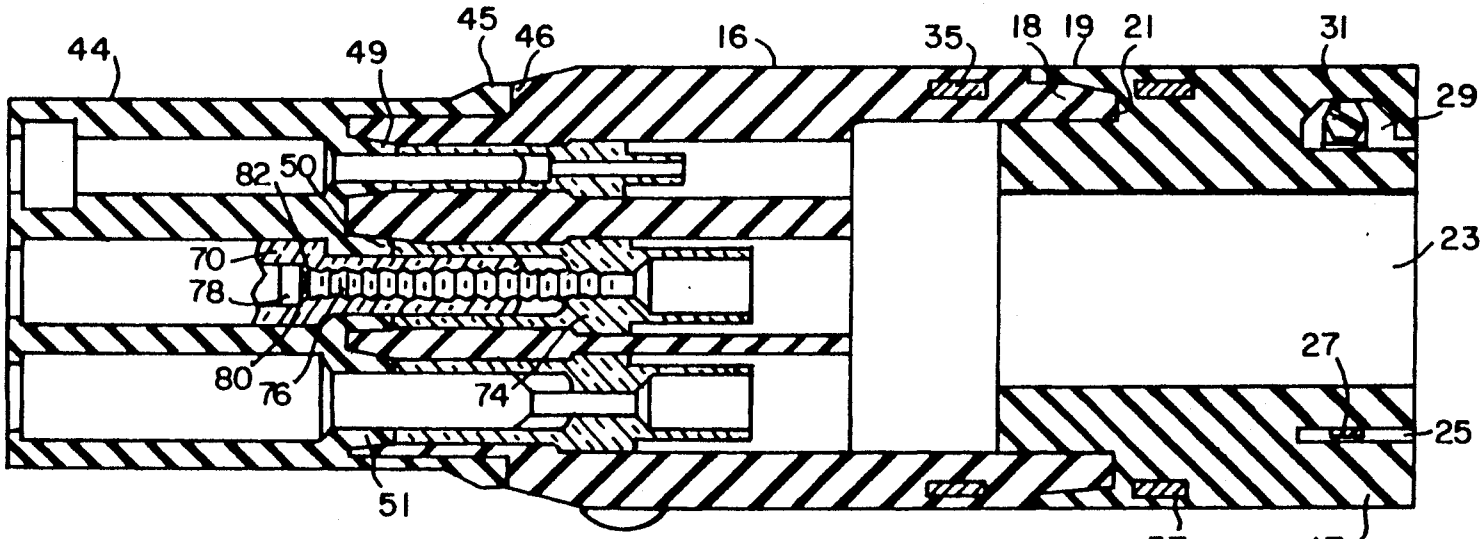
FIG. 1 is a view in section of one form of connector built in accordance with the present invention.

FIG. 1 is a view in section of one form of connector of the present invention which is made of resilient material. At the left, there may be seen the replaceable nose 44 which is similar in most respects to the replaceable nose shown in my above-cited patent. The nose 44 has an enlarged end which forms an axially extending flange 45. The flange 45 overlies an end of the body 16 and abuts a shoulder 46 when the nose is tightened in place on the connector body 16.

In addition to the flange 45, the nose is provided with integral sealing cones 49, 50 and 51 also made of rubber or rubber-like material. Actually, there are similar cones surrounding each of the leads of the nose and the cones 49, 50, and 51 are typical. The cone which surrounds each lead fits into a correspondingly tapered opening in the connector body 16. A typical sealing screw 76 has a head 78 which bears upon a shoulder 82 formed in the spring contact 70. An O-ring seal 80 may be interposed between the head 78 and the shoulder 82. The sealing screw 76 passes through the hollow contact 70 and is screwed into the contact 74 which is fixed in the body 16. Each sealing screw passes through an axial opening in a hollow contact member in the nose 44 to be screwed into a threaded opening in an associated contact fixed in the connector body 16. Each such screw is provided with an O-ring seal and the contact it bears upon is surrounded by a sealing cone in the manner illustrated.

At the extreme right of FIG. 1, the connector body 16 is joined to a grommet 17. The body 16 is generally rectangular in cross-section and has a tapered peripheral extension or lip 18. A recess 21 having a complementary taper is formed by a peripheral extension or lip 19 on the shell of the grommet which fits closely about the extension 18 on the body 16. Either or both lips may be made of resilient material. Internal seals are also formed between the body 16 and the grommet 17. An internal central passage 23 is formed through the grommet 17 for a power line which may consist of banded conductors or a jacketed cable. A circular slot 25 is formed in the end of the grommet 17 to accommodate a hose clamp 27. The slot 25 has an enlargement 28 for a clamping screw 31. An opening 29 in the wall of the grommet tangential to the hose clamp gives access to the head of the screw head 31 for adjusting the tension of the clamp about the power line. When a jacketed cable is used, the clamp is tightened to effect a seal between the wall of the opening 23 and the outer jacket of the cable. As seen more clearly in FIG. 2, the grommet 17 is then firmly attached to the body 16 by means of four axially disposed corner screws spaced about the periphery of the grommet, the screw 30 being typical, and each screw passing through a corner of the extension 19 to thread into the body 16 at its corners.

Figure 2:
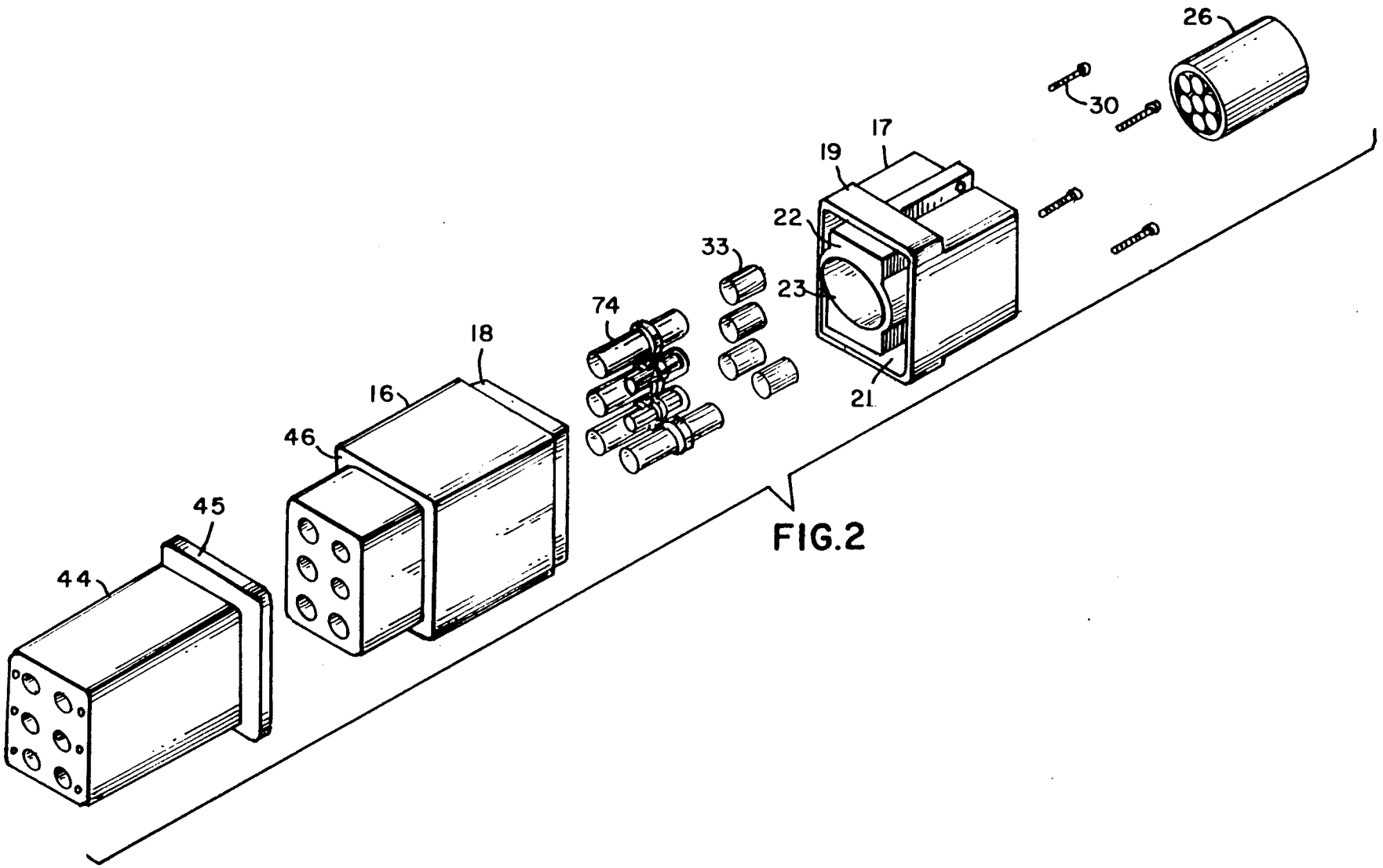
FIG. 2 is an exploded view of a connector similar to that of FIG. 1 but illustrating additional components, including a short section of cable.

In the exploded view of FIG. 2, the configuration of the shell and of the interior of the grommet are more clearly seen. Crimp sleeves as at 33 are fixed to the individual conductors of the cable 26. The crimp sleeves 33 are of the proper diameter to accept the contacts such as that shown at 74.

Reverting to FIG. 1, there may be seen a stiffening member 35 which is molded into the body shell adjacent the extension 18. A similar stiffening member 37 is molded in the grommet adjacent the extension 19. These stiffening members, which may be made of steel or other relatively rigid material, aid in maintaining the integrity of the seal which is formed between the extensions 18 and 19. Also, of course, they serve to prevent deformation of the extensions.

Figure 3:
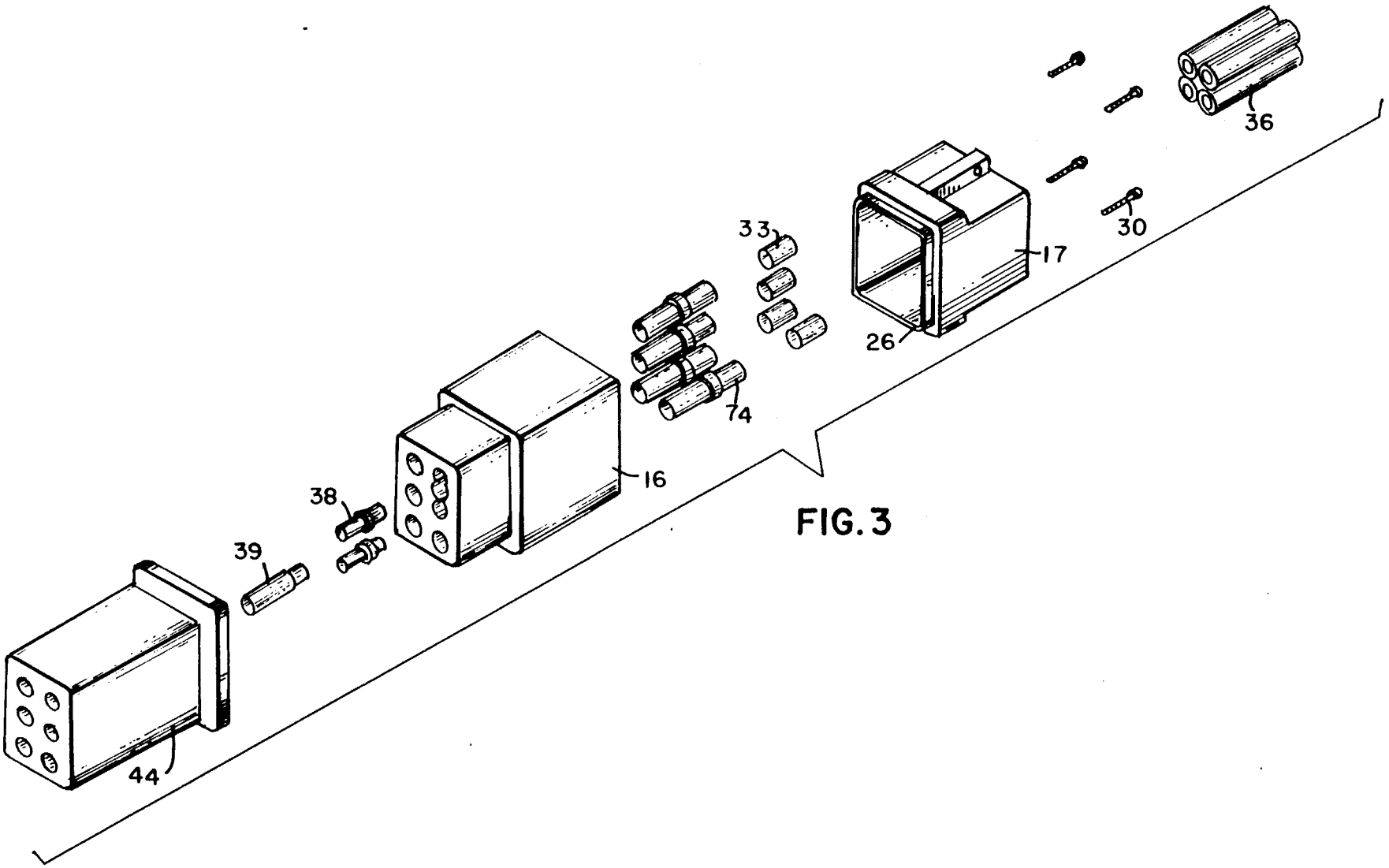
FIG. 3 is an exploded view of a connector similar to FIG. 2 but illustrating a version of the invention utilized for banded single conductors.

In the exploded view of FIG. 3, a connector similar to that of FIG. 2 is shown. In this case, however, rather than a cable 36 a group of banded conductors 36 is utilized. Some other minor differences are also evident. For example, the banded single conductor assembly actually consists of a combination of four individual power conductors and a centrally disposed control cable having two small conductors for connection to relay contacts. The four power conductors are connected to the crimp sleeves 33 in the same manner as those of FIG. 2. The two small conductors of the central control cable of group 36 are crimped in the sleeves 38 and a plug 39 maintains separation between the two in the connector body.

The peripheral seals between the body 16 and the grommet 17 of FIG. 3 are also somewhat different. The rubber extension or lip 26 on the grommet 17 of FIG. 3 fits internally into the body 16 where a seal is formed between the lip 26 and a complementary surface within the outer shell of the body 16.

Figure 4:
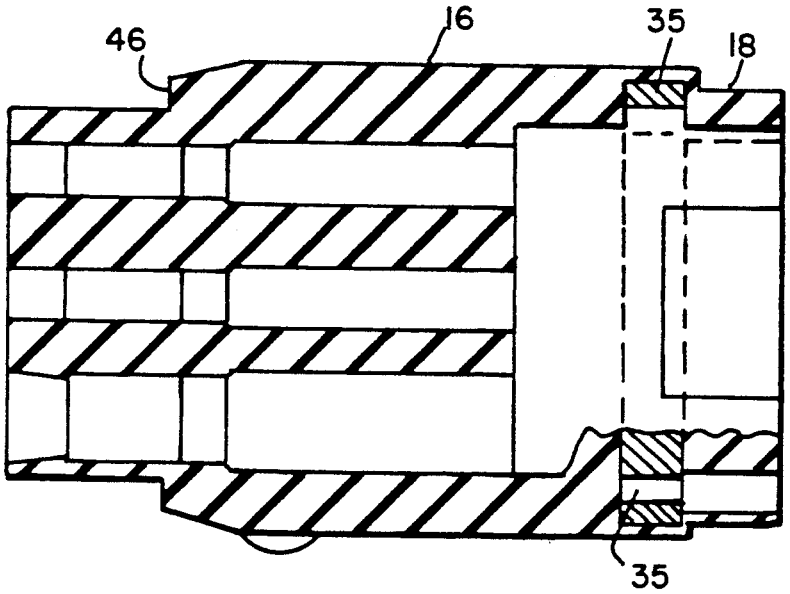
FIG. 4 is a view in section of the connector body used in the embodiment of FIG. 3.

FIG. 4 is a sectional view of the connector body 16 similar to that used in the embodiment of FIG. 3. It will be noted that sealing between the body 16 and the grommet 17 is achieved by the use of sealing cones such as 49 and 51 extending axially from the body 16 to be received in correspondingly tapered openings in the grommet 17. In this instance, sealing is accomplished about the individual conductor contacts in contrast to the sealing to the jacket of the cable.

What is claimed is:

1. A system for connecting a power source by means of a power line to an aircraft having an input power socket comprising a connector having a body including a replaceable nose at one end thereof for insertion in said socket, a grommet having a passage formed therethrough to accommodate said power line, a peripheral adjustable clamp disposed in said grommet for gripping said power line, and means for attaching said grommet in sealed relationship to the other end of said body.

2. A system as defined in claim 1 wherein said power line, said body, said grommet and said peripheral clamp are in axial alignment, said grommet having an opening formed in a wall thereof tangential to said clamp to permit access to said clamp for adjustment thereof.

3. A system as defined in claim 1, in which said means for attaching said grommet in sealed relationship to said other end of said body comprises at least a pair of cooperating resilient members, a first member extending from the other end of said body and a second member extending from said grommet, and attaching screws for holding said body and said grommet in close relationship with said first member in intimate contact with said second member to provide a seal therebetween.

4. A system as defined in claim 3 wherein said first and second members are peripheral extensions of said body and said connector respectively which meet in overlapping relationship to provide said seal between said body and said grommet.

5. A system as defined in claim 4 wherein said power line is comprised of individual conductors and further including tapered conical extensions formed on said other end of said body and composed of resilient material, contact members fixed to the ends of said individual conductors, said contact members terminating in tapered openings for receiving said conical extensions in sealed relationship.

* * * * *